US007446642B2

(12) United States Patent
Fang et al.

(10) Patent No.: US 7,446,642 B2
(45) Date of Patent: Nov. 4, 2008

(54) INDUCTOR

(75) Inventors: Jung-Chan Fang, Taoyuan Hsien (TW); Chen-Feng Wu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/878,231

(22) Filed: Jul. 23, 2007

(65) Prior Publication Data

US 2008/0024263 A1 Jan. 31, 2008

(30) Foreign Application Priority Data

Jul. 28, 2006 (TW) ..... 95127664 A

(51) Int. Cl.
*H01F 27/30* (2006.01)
*H01F 27/24* (2006.01)

(52) U.S. Cl. ..... 336/212; 336/208; 336/198

(58) Field of Classification Search ..... 336/212, 336/208, 198, 192
See application file for complete search history.

(56) References Cited

U.S. PATENT DOCUMENTS

| | | | | |
|---|---|---|---|---|
| 4,945,332 | A * | 7/1990 | Sakamoto et al. | 336/69 |
| 5,266,916 | A * | 11/1993 | Kijima | 336/160 |
| 5,831,505 | A * | 11/1998 | Yamaguchi et al. | 336/83 |
| 6,624,724 | B2 * | 9/2003 | Tomita et al. | 333/181 |
| 2002/0195973 | A1 * | 12/2002 | Hu et al. | 315/276 |
| 2006/0125591 | A1 * | 6/2006 | Yang et al. | 336/208 |

* cited by examiner

*Primary Examiner*—Anh T Mai
(74) *Attorney, Agent, or Firm*—Birch, Stewart, Kolasch & Birch, LLP

(57) ABSTRACT

An inductor includes a bobbin, a first winding, a second winding, a core set and a magnetic element. The first and second windings are respectively wound around the bobbin and separated by a partition, which is formed on the bobbin and has a recess for accommodating the magnetic element. The core set has one portion passing through the bobbin and the other portion surrounding the bobbin, the first winding and the second winding. The magnetic element is connected with the one portion of the core set passing through the bobbin and is apart from the other portion of the core set outside the bobbin by a gap.

16 Claims, 6 Drawing Sheets

1

2

INDUCTOR

CROSS REFERENCE TO RELATED APPLICATIONS

This Non-provisional application claims priority under 35 U.S.C. §119(a) on Patent Application No(s). 095127664 filed in Taiwan, Republic of China on Jul. 28, 2006, the entire contents of which are hereby incorporated by reference.

BACKGROUND OF THE INVENTION

1. Field of Invention

The invention relates to an inductor, and, in particular, to an inductor capable of filtering out a common-mode noise and a differential-mode noise simultaneously.

2. Related Art

Because a circuit used in an electronic apparatus, such as a power supply or a power transformer, frequently operates in a high-frequency switching environment, the electro-magnetic element interference (EMI) tends to occur and thus influences the operation of the electronic apparatus. The EMI can be classified into the radiated EMI and the conducted EMI according to a transfer method. The radiated EMI is directly transferred in an open space, while the conducted EMI is transferred through wires.

The conducted EMI may be classified into a common-mode noise and a differential-mode noise according to a conducting path of a noise current. The differential-mode noise occurs when two wires have opposite current flowing directions, and the common-mode noise occurs when all the wires have the same current flowing direction.

In order to eliminate the EMI effectively, an inductor for eliminating the type of the noise is correspondingly disposed in the electronic apparatus according to the type of the noise to be eliminated. For example, if the common-mode noise is to be eliminated, the inductor capable of eliminating the common-mode noise is necessary to dispose in the electronic apparatus. If the differential-mode noise is to be eliminated simultaneously, an additional inductor is need to disposed in the electronic apparatus for eliminating the differential-mode noise. However, this method needs to add inductors, thereby wasting the space in the electronic apparatus, disabling the electronic apparatus from being miniaturized, and increasing the manufacturing cost due to the numerous elements used.

In order to solve the above-mentioned problems, there is provided a conventional inductor 1 including a magnetic element bobbin 11, a primary winding 12, a secondary winding 13, an core set 14 and a frame 15, as shown in FIGS. 1 and 2. The primary winding 12 and the secondary winding 13 are respectively wound around two sides of the magnetic element bobbin 11. The core set 14 is composed of two cores 14*a* and 14*b*. First ends of the cores 14*a* and 14*b* oppositely pass through the magnetic element bobbin 11, the primary winding 12 and the secondary winding 13. Second ends of the cores 14*a* and 14*b* are connected to each other outside the magnetic element bobbin 11. The frame 15 fixes the core set 14. The inductor 1 has the property of the common-mode inductor according to the magnetic element property of the magnetic element bobbin 11 and the cooperation of the magnetic element bobbin 11, the primary winding 12, the secondary winding 13 and the core set 14. In addition, the property of the differential-mode inductor is obtained because the lines of magnetic element forces of the primary winding 12 and the secondary winding 13 are parallel to each other. Although the inductor 1 can eliminate the electromagnetic element interference, the manufacturing cost is relatively increased because it is difficult to shape the magnetic element material into the bobbin in terms of the shaping technology.

Therefore, it is an important subject to provide an inductor, which is capable of filtering out the common-mode noise and the differential-mode noise simultaneously, and can be integrated into one single device in order to facilitate the miniaturization of the device and increase the degree of freedom in the circuit design.

SUMMARY OF THE INVENTION

In view of the foregoing, the invention is to provide an inductor, which is capable of filtering out a common-mode noise and a differential-mode noise simultaneously, and can be integrated into one single device in order to facilitate the miniaturization of the device and increase the degree of freedom in the circuit design.

To achieve the above, an inductor according to the invention includes a bobbin, a first winding, a second winding, a core set and a magnetic element. The bobbin has a first winding area, a second winding area and a partition. The partition is disposed between the first winding area and the second winding area, and the partition has a recess for accommodating the magnetic element. The bobbin further has a through hole passing through the partition, the first winding area and the second winding area so that one portion of the core set passes through the through hole. The magnetic element is connected to the core set passing through the through hole, and is apart from the other portion of the core set outside the bobbin by a gap.

As mentioned above and compared with the prior art, the core set, the first winding and the second winding cooperate to generate the effect of filtering out the common-mode noise, and the magnetic element, the core set, the first winding and the second winding cooperate to generate the effect of filtering out the differential-mode noise in this invention. So, the common-mode noise and the differential-mode noise can be filtered out simultaneously. In addition, the gap existing between the core set and the magnetic element can increase the differential-mode inductance and thus enhance the effect of filtering out the differential-mode noise. In addition, the inductor can be integrated into one single device in order to facilitate the miniaturization of the device, save the layout space and increase the degree of freedom in the circuit design.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
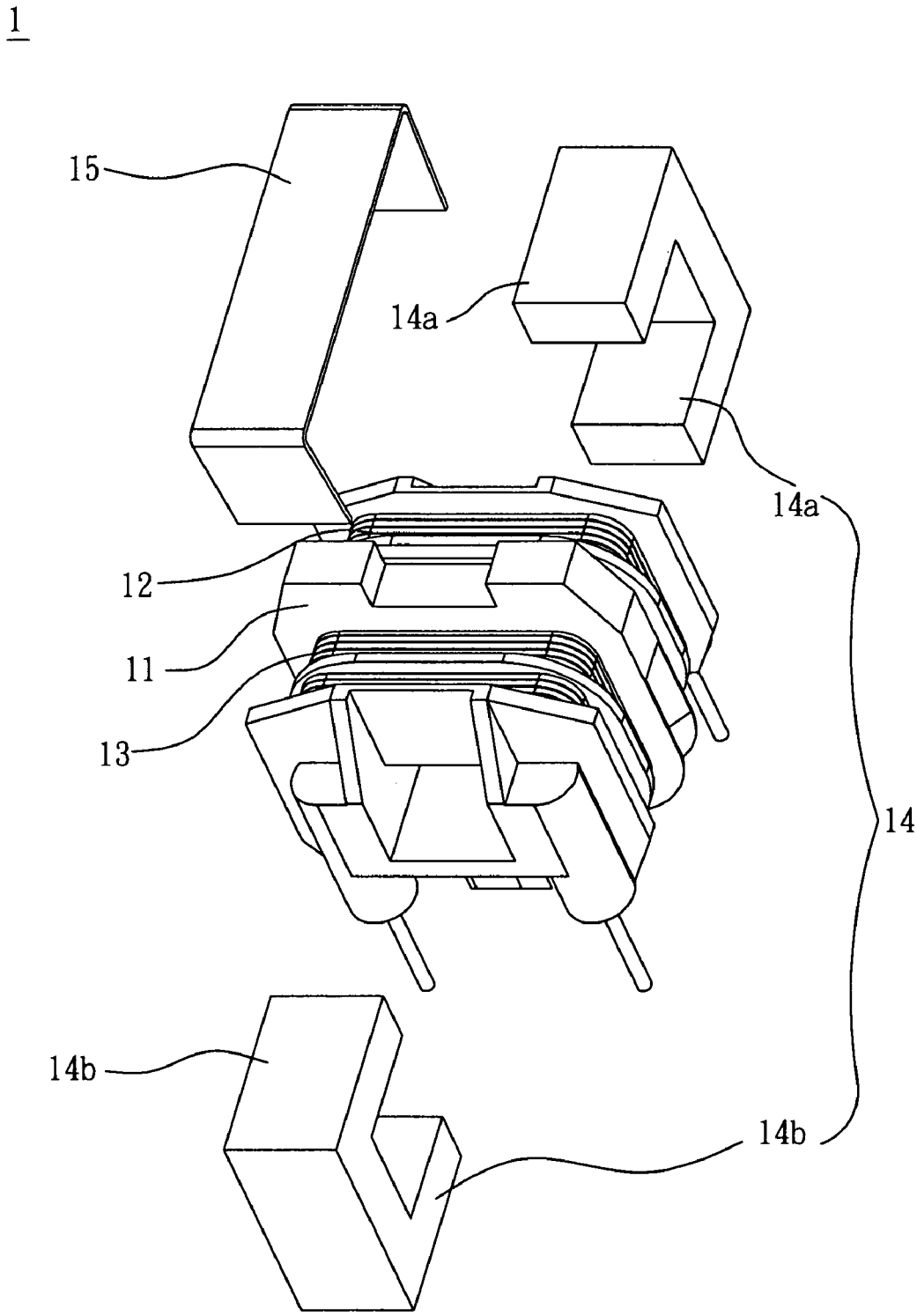
FIG. 1(PRIOR ART)
FIG. 1 is an exploded view showing a conventional inductor.
Figure 2:
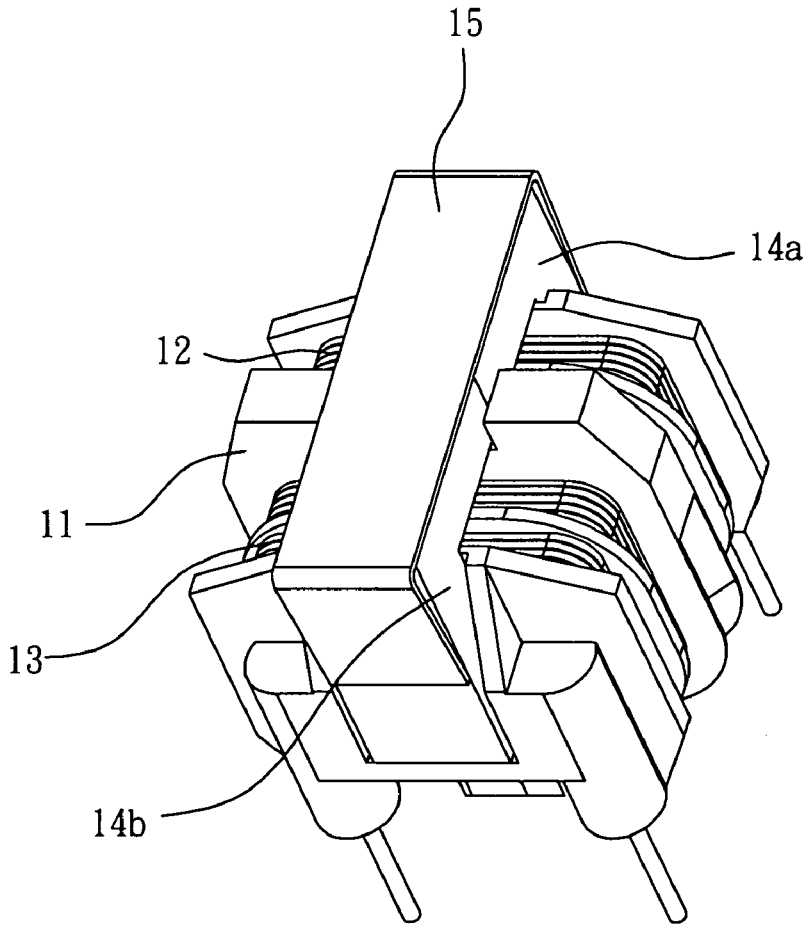
FIG. 2(PRIOR ART)
FIG. 2 is an assembled view showing the inductor of FIG. 1.
Figure 3:
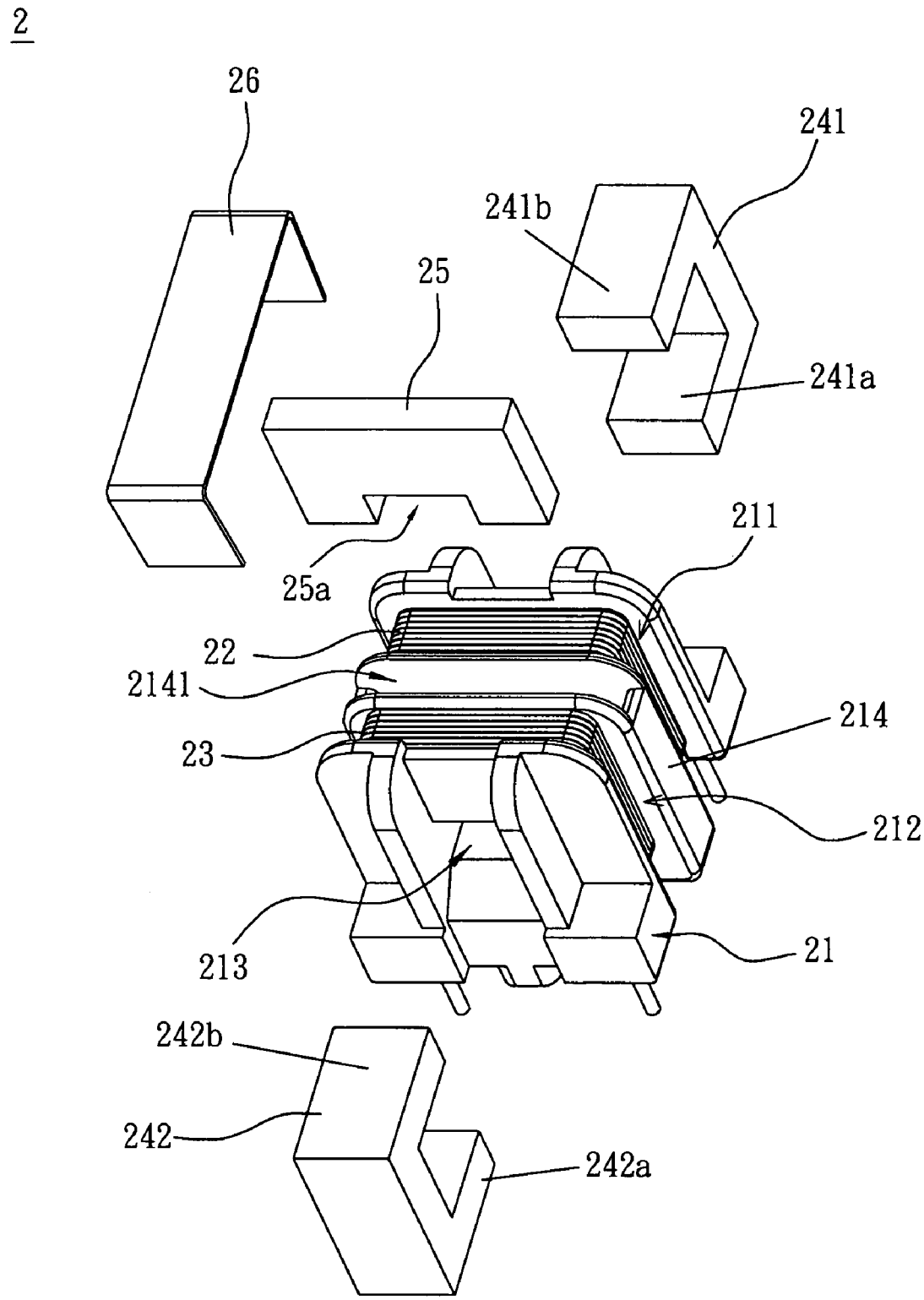
FIG. 3 is an exploded view showing an inductor according to an embodiment of the invention.
Figure 4:
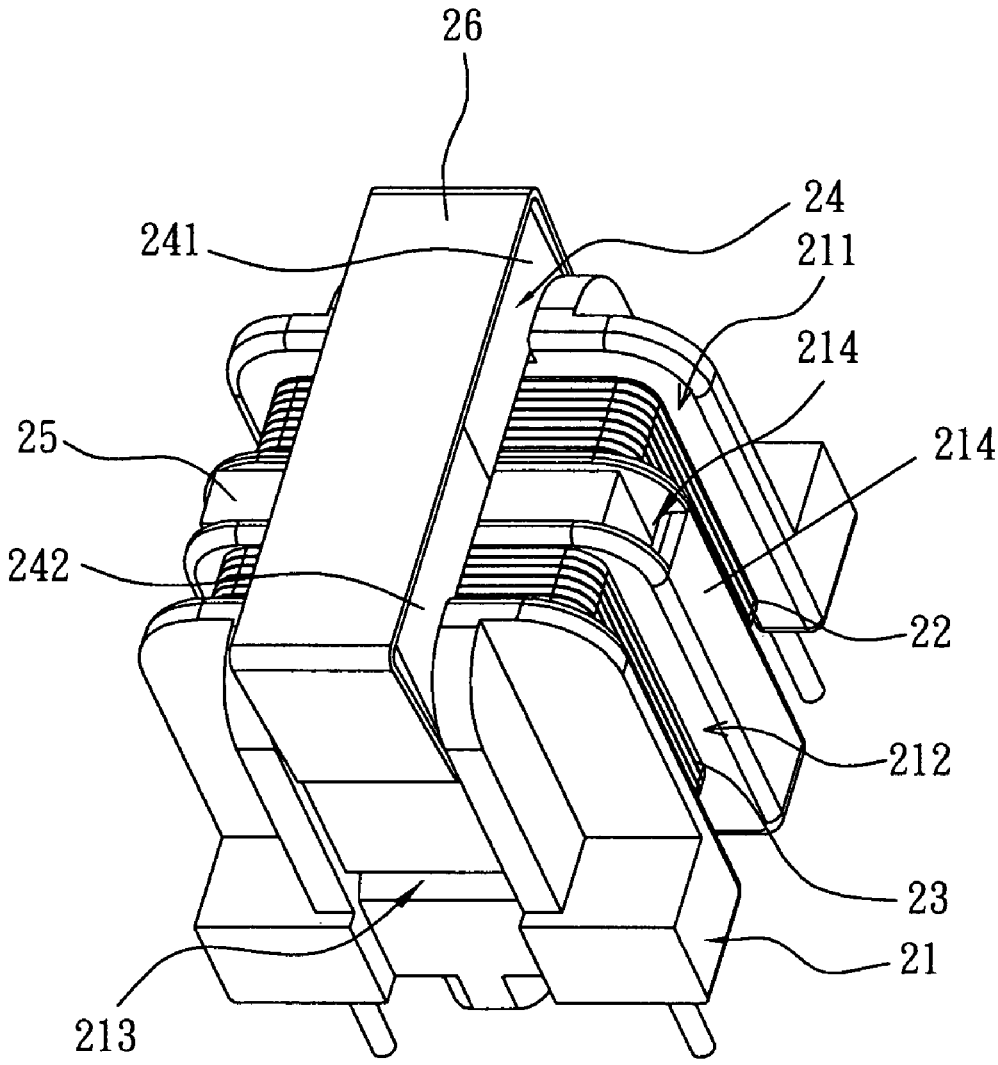
FIG. 4 is an assembled view showing the inductor of FIG. 3.

Referring to FIGS. 3 and 4, an inductor 2 according to an embodiment of the invention includes a bobbin 21, a first winding 22, a second winding 23, a core set 24 and a magnetic element 25.

In this embodiment, the bobbin 21 has a first winding area 211, a second winding area 212 and a partition 214, which is disposed between the first winding area 211 and the second winding area 212 and has a recess 2141 formed therein. The bobbin 21 further has a through hole 213 passing through the partition 214, the first winding area 211 and the second winding area 212. The material of the bobbin 21 of this embodiment is not particularly restricted, but is preferably a non-magnetic element material including, without limitation to, a plastic material.

The first winding 22 is wound around the first winding area 211, and the second winding 23 is wound around the second winding area 212. The first winding 22 is a primary winding, and the second winding 23 is a secondary winding. The first winding 22 may also be the secondary winding, and the second winding 23 is the primary winding.

Figure 5:
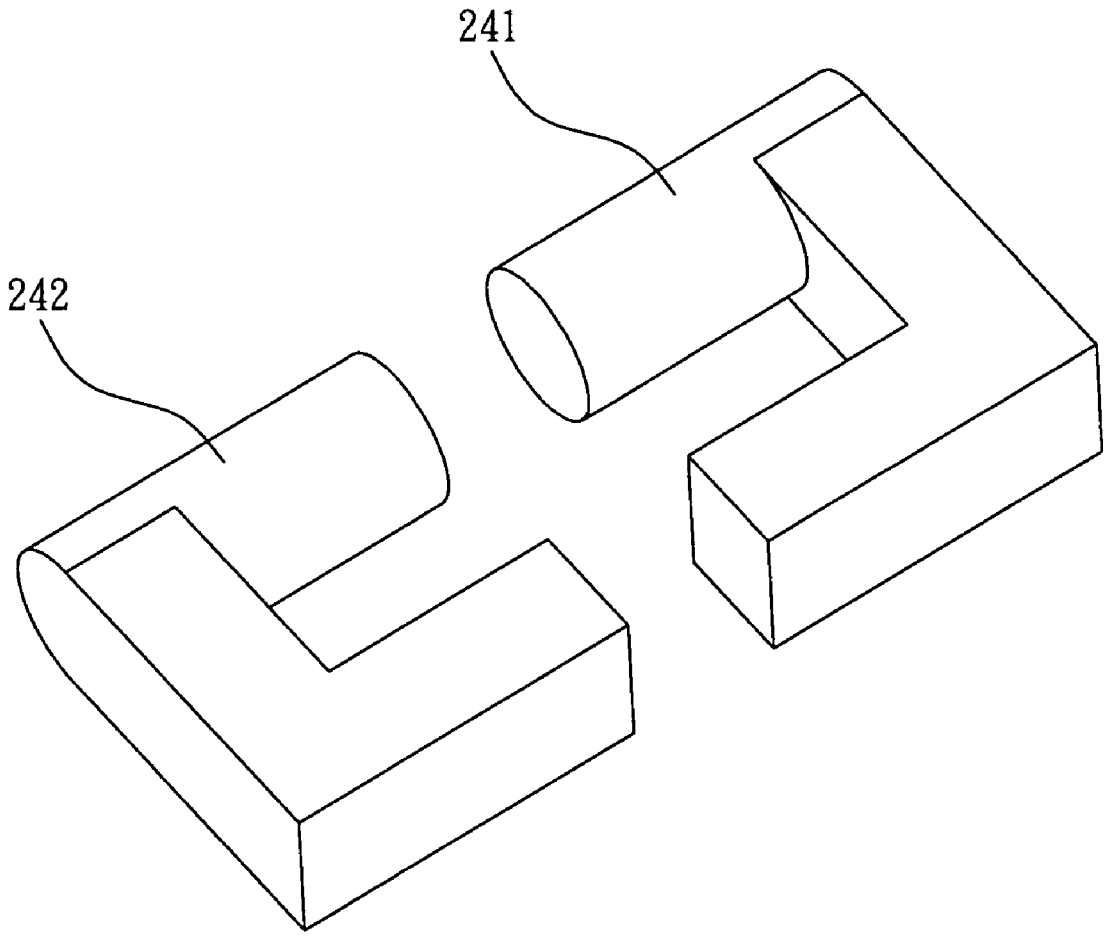
FIG. 5 is a schematic illustration showing another core set according to the embodiment of the invention.

The core set 24 is composed of a first core 241 and a second core 242 each having a substantial U-shape. An end portion 241*a* of the first core 241 and an end portion 242*a* of the second core 242 oppositely pass through the through hole 213 and are connected with each other. The other end portion 241*b* of the first core 241 and the other end portion 242*b* of the second core 242 are connected with each other outside the bobbin 21. So, the core set 24 can pass through and surround the first winding 22 and the second winding 23. Each of the cross-sectional areas of the end portions of the first core 241 and the second core 242 is not restricted to have the particular shape, and may have the rectangular shape (see FIG. 3), the circular shape (see FIG. 5) or any other shape.

The inductor 2 further includes a frame 26 for covering the portion of the core set 24 outside the bobbin 21, and thus fixing the first core 241 and the second core 242. The frame 26 may be connected to the core set 24 by way of adhering, embedding or locking.

Figure 6:
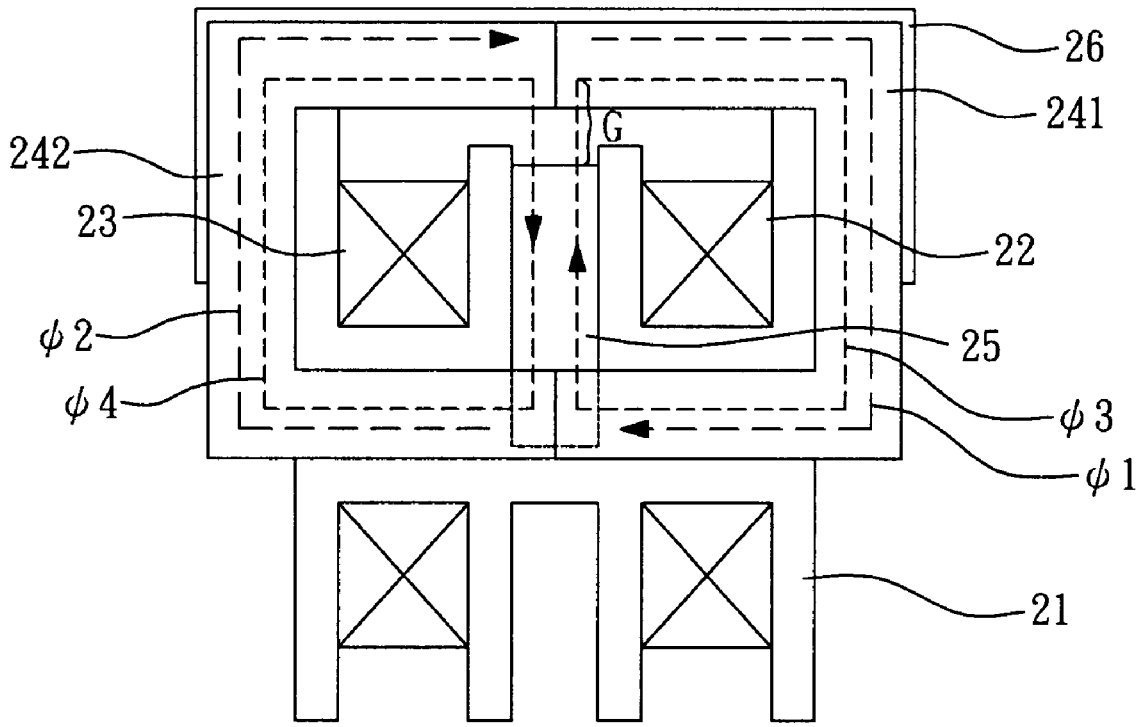
FIG. 6 is a schematic illustration showing a magnetic element flux flow in the inductor according to the embodiment of the invention.

The magnetic element 25 is accommodated within the recess 2141 of the partition 214 and apart from the portion of the core set 24 outside the bobbin 21 (i.e., the end portion 241*b* of the first core 241 and the end portion 242*b* of the second core 242) by a gap G (see FIG. 6). Preferably, a lateral side of the magnetic element 25 is formed with a slot 25*a*, and the end portion 241*a* of the first core 241 and the end portion 242*b* of the second core 242 may pass through the slot 25*a* and may be connected with each other in order to ensure that the magnetic element 25 is connected with the first core 241 and the second core 242.

As shown in FIG. 6, the operation of the inductor 2 will be described in the following. First, the inductor 2 receives an external power (not shown), and inputs the external power to the first winding 22. The first winding 22 generates a first magnetic element flux ψ1 in the first core 241 according to the magnetic element effect of the electric current. The second winding 23 is influenced by the first magnetic element flux ψ1 due to the electromagnetic element induction principle, and then generates a second magnetic element flux ψ2 in the second core 242 according to the magnetic element effect of the electric current. When the current flowing through the first winding 22 and the current flowing through the second winding 23 have the same phase, the directions of the first magnetic element flux ψ1 and the second magnetic element flux ψ2 are the same and overlap with each other. So, the inductor 2 has the effect of filtering out the common-mode noise.

When the external power is inputted to the first winding 22, the first winding 22 generates a third magnetic element flux ψ3 in the magnetic element 25 and the first core 241 according to the magnetic element effect of the electric current, and the second winding 23 is also influenced by the third magnetic element flux ψ3 and generates a fourth magnetic element flux ψ4 in the magnetic element 25 and the second core 242 according to the electromagnetic element induction principle and the magnetic element effect of the electric current. If the currents flowing through the first winding 22 and the second winding 23 have opposite phases, the third magnetic element flux ψ3 and the fourth magnetic element flux ψ4 have different directions and are thus offset. Thus, the inductor 2 has the effect of filtering out the differential-mode noise.

Because the magnetic element 25 is apart from the core set 24 by the gap G, the differential-mode inductance may be further increased and the effect of filtering out the differential-mode noise may be enhanced. The size of the gap G may be determined according to the actual requirement.

In summary, compared with the prior art, the inductor of the invention generates the effect of filtering out the common-mode noise according to the cooperation of the core set, the first winding and the second winding, and generates the effect of filtering out the differential-mode noise according to the cooperation of the magnetic element, the core set, the first winding and the second winding. Thus, the common-mode noise and the differential-mode noise may be filtered out simultaneously. Also, the structure design of the gap between the core set and the magnetic element can increase the differential-mode inductance and thus enhance the effect of filtering out the differential-mode noise. In addition, the inductor may be integrated into one single device in order to facilitate the miniaturization of the device, save the layout space and increase the degree of freedom in the circuit design.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. An inductor comprising:

a bobbin having a first winding area, a second winding area, a partition and a through hole, wherein the partition is disposed between the first winding area and the second winding area;

a first winding wound around the first winding area;

a second winding wound around the second winding area;

a core set partially passing through the through hole and partially surrounding the bobbin, the first winding and the second winding; and a magnetic element disposed in the partition and apart from the core set partially surrounding the bobbin by a gap, wherein the magnetic element has a slot formed on one side thereof for passing the core set therethrough.

2. The inductor according to claim 1, wherein the first winding is a primary winding and the second winding is a secondary winding.

3. The inductor according to claim 1, wherein a material of the bobbin is a non-magnetic element material or a plastic material.

4. The inductor according to claim 1, wherein the core set comprises a first core and a second core, both of which are a substantially U-shaped.

5. The inductor according to claim 4, wherein the core set has a rectangular, circular or irregular cross section.

6. The inductor according to claim 1, further comprising a frame disposed on the core set surrounding the bobbin.

7. The inductor according to claim 6, wherein the frame is connected with the core set by adhering, embedding or engaging.

8. The inductor according to claim 1, wherein the partition has a recess for accommodating the magnetic element.

9. An inductor, comprising:

a bobbin having a partition;

a first winding wound around the bobbin;

a second winding wound around the bobbin, wherein the partition separates the first winding from the second winding;

a first core having one end portion passing through the bobbin, and the other end portion outside the bobbin;

a second core having one end portion passing through The bobbin, and the other end portion outside the bobbin; and a magnetic element disposed in the partition and contacted to the one end portion of the first core and the one end portion of the second core, both of which pass through the bobbin, wherein the magnetic element has a slot formed on one side thereof for passing the one end portion of the first core through the bobbin and the one end portion of the second core are contacted therein.

10. The inductor according to claim 9, wherein the partition has a recess for accommodating the magnetic element.

11. The inductor according to claim 9, wherein each of the first core and the second core has a substantial U shape.

12. The inductor according to claim 11, wherein the first core and the second core have a rectangular, circular or irregular cross section.

13. The inductor according to claim 9, wherein a material of the bobbin is a non-magnetic element material or a plastic material.

14. The inductor according to claim 9, further comprising a frame for covering the other end portions of the first core and the second core outside the bobbin.

15. The inductor according to claim 14, wherein the frame is connected with the first core and the second core by adhering, embedding or locking method.

16. The inductor according to claim 9, wherein the magnetic element is apart from the other end portions of the first core and the second core outside the bobbin by a gap.

* * * * *